US012193579B1

(12) United States Patent
González Nuñez et al.

(10) Patent No.: US 12,193,579 B1
(45) Date of Patent: Jan. 14, 2025

(54) TRANSPORTABLE GRAVITY FLOW DISPLAY RACK FOR FOOD OR DRINK CONTAINERS AND METHOD OF USING THE SAME

(71) Applicant: Vaqueria Tres Monjitas, Inc., San Juan, PR (US)

(72) Inventors: Orlando González Nuñez, Carolina, PR (US); Luis A. García Vázquez, Guaynabo, PR (US)

( * ) Notice: Subject to any disclaimer, the term of this patent is extended or adjusted under 35 U.S.C. 154(b) by 0 days.

(21) Appl. No.: 18/237,571

(22) Filed: Aug. 24, 2023

(51) Int. Cl.
*A47F 1/12* (2006.01)
*B65D 19/44* (2006.01)

(52) U.S. Cl.
CPC ..... *A47F 1/12* (2013.01); *B65D 19/44* (2013.01); *B65D 2519/00796* (2013.01); *B65D 2519/00815* (2013.01)

(58) Field of Classification Search
CPC .... A47F 1/04; A47F 1/12; A47F 1/121; A47F 1/123; A47F 1/125; A47F 1/126; A47F 1/128; A47F 5/0018; A47F 5/0025; A47F 5/0031; A47F 5/0037; A47F 10/02; A47F 10/04; A47F 2005/165; A47F 2010/025; A47B 96/025; B25H 3/04; B65D 19/38; B65D 19/44; B65D 2519/00796; B65D 2519/00815
USPC ..... 211/85.4
See application file for complete search history.

(56) References Cited

U.S. PATENT DOCUMENTS 2,925,195 A * 2/1960 Faulkner ..... A47F 1/12 221/92
3,900,112 A * 8/1975 Azzi ..... B65G 1/023 211/151
4,270,661 A * 6/1981 Rosenband ..... A47F 1/12 211/191
4,416,380 A * 11/1983 Flum ..... A47F 1/121 211/181.1
4,886,171 A * 12/1989 Spamer ..... A47F 7/28 211/74
4,953,719 A * 9/1990 Spamer ..... A47B 87/0223 211/188
5,607,068 A * 3/1997 Coretti, Jr. ..... A47F 5/135 211/59.2
8,020,714 B2 * 9/2011 Miller, Jr. ..... A47F 3/0404 108/107
D730,089 S * 5/2015 Carbone ..... D6/675.1
D787,242 S * 5/2017 Hsu ..... D6/675.2
11,160,369 B2 * 11/2021 Marriott ..... A47F 5/005
11,160,374 B1 * 11/2021 Davis ..... A47F 1/12
11,523,687 B2 * 12/2022 Koetter, Jr. ..... A47B 81/007
D979,298 S * 2/2023 Bogdan ..... A47F 5/00 D6/675.4

(Continued)

FOREIGN PATENT DOCUMENTS

FR 2842789 A1 * 1/2004 ..... B65D 19/38

*Primary Examiner* — Joshua E Rodden
(74) *Attorney, Agent, or Firm* — Eugenio J. Torres-Oyola; Victor M. Rodriguez-Reyes; Rafael Rodriguez-Muriel

(57) ABSTRACT

A transportable gravity flow display rack for food and/or drink containers (such as milk gallons) having a pallet base adapted to receive the forks from a forklift or pallet jack, a plurality of vertical upright supports, a first cross bar and a second cross bar, and one or more inclined storage racks, thereby facilitating the flow of the containers towards a costumer in response to gravity.

10 Claims, 10 Drawing Sheets

(56) References Cited

U.S. PATENT DOCUMENTS

| | | | | |
|---|---|---|---|---|
| 2003/0038101 | A1* | 2/2003 | Linder | B65D 19/44 211/168 |
| 2004/0020878 | A1* | 2/2004 | Boron | A47F 1/12 211/188 |
| 2004/0177792 | A1* | 9/2004 | Salmanson | A47B 57/22 108/55.1 |
| 2008/0197089 | A1* | 8/2008 | Chang | A47F 1/12 211/59.2 |
| 2011/0114578 | A1* | 5/2011 | Jacobs | A47F 5/005 211/59.2 |
| 2015/0102710 | A1* | 4/2015 | Hottmann | G09F 3/00 312/236 |
| 2020/0268152 | A1* | 8/2020 | Siples | A01G 9/023 |
| 2021/0112997 | A1* | 4/2021 | Walton | A47F 5/10 |
| 2023/0284798 | A1* | 9/2023 | Obitts | A47B 57/406 |

* cited by examiner

TRANSPORTABLE GRAVITY FLOW DISPLAY RACK FOR FOOD OR DRINK CONTAINERS AND METHOD OF USING THE SAME

CROSS-REFERENCE TO RELATED APPLICATION

N/A

STATEMENT REGARDING FEDERALLY SPONSORED RESEARCH AND DEVELOPMENT

N/A

BACKGROUND OF THE INVENTION

Field of the Invention

The present invention relates to a transportable gravity flow display rack for food and/or drink containers.

Discussion of the Background

In the retail industry it is important to maximize inventory space but at the same time it is important to make the products as attractive as possible for the consumer. One problem with the shelving of products in the retail industry is having to quickly restock these shelves with their corresponding products once they have been bought or removed by the customers. In some instances, the store or establishment's staff must go to the storage room to look for boxes of the products, unpack them, and then individually place the products in the corresponding shelf or rack. Instead of having to individually place products on a shelf, it would be desirable to have a mechanism for replacing an empty shelf with a fully stocked shelf. Particularly, one where the empty rack can be removed, and replaced by a fully stocked one in a matter of seconds.

U.S. Pat. No. 6,783,012 to Webb shows a rack with shelves on opposing sides and openings to receive lifting forks. Webb's patent uses as a base eight pegs, wherein six are located in the front and back opposite to each other and two are located between them on the sides to allow front, back and side access by lifting forks. However, the use of pegs to allow side access instead of using longitudinal parallel bars as a base reduce the structural strength of the base. Also, Webb's patent requires that the shelves be reloaded through the front given that the back sections of the shelves are obstructed by the shelves on the opposing side. Access for reloading through the back of the rack is important because it allows for the store employees to reload without interrupting consumer use of the rack to pick up their favorite items. Also, on many occasions, these racks will stock refrigerated products. The racks will be housed inside refrigerated areas that allow consumer access only through front doors, limiting access to the back of the rack to employees for restocking or for removing the racks for replacement. Therefore, there is a need for a rack with back section access for restocking that does not interrupt consumer interaction with the displayed products in the rack.

SUMMARY OF THE INVENTION

A transportable gravity flow storage rack for food and/or drink containers, comprising, inter alia, a pallet base adapted to receive the forks from a forklift or pallet jack; one or more inclined storage racks; a plurality of vertical upright supports; a first cross bar and a second cross bar; wherein each of the first inclined storage rack, the second inclined storage rack, and the third inclined storage rack from the one or more inclined storage racks includes a first bar, a second bar, a third bar, and a fourth bar; wherein each of the second bar from the first inclined storage rack, the second bar from the second inclined storage rack, and the second bar from the third inclined storage rack are welded or connected to the third vertical upright support and the sixth vertical upright support from the plurality of vertical upright supports at a point vertically higher than the point where the first bar from the first inclined storage rack, the first bar from the second inclined storage rack, and the first bar from the third inclined storage rack are welded or connected to the first vertical upright support and the fourth vertical upright support from the plurality of vertical upright supports, thereby facilitating the flow of the containers stored thereon towards a costumer in response to gravity.

DETAILED DESCRIPTION OF THE INVENTION

The present disclosure discloses several exemplary embodiments of a transportable gravity flow display rack for food and/or drink containers, as further described below.

FIGS. 1-8 show a transportable gravity flow storage rack 1 for food and/or drink containers comprising a pallet base 2, one or more inclined storage racks 3*a*, 3*b*, 3*c*, and a plurality of vertical upright supports 4*a*, 4*b*, 4*c*, 4*d*, 4*e*, 4*f*. The transportable gravity flow storage rack 1 is preferably manufactured from stainless steel, but any other durable material may be used.

Figure 2:
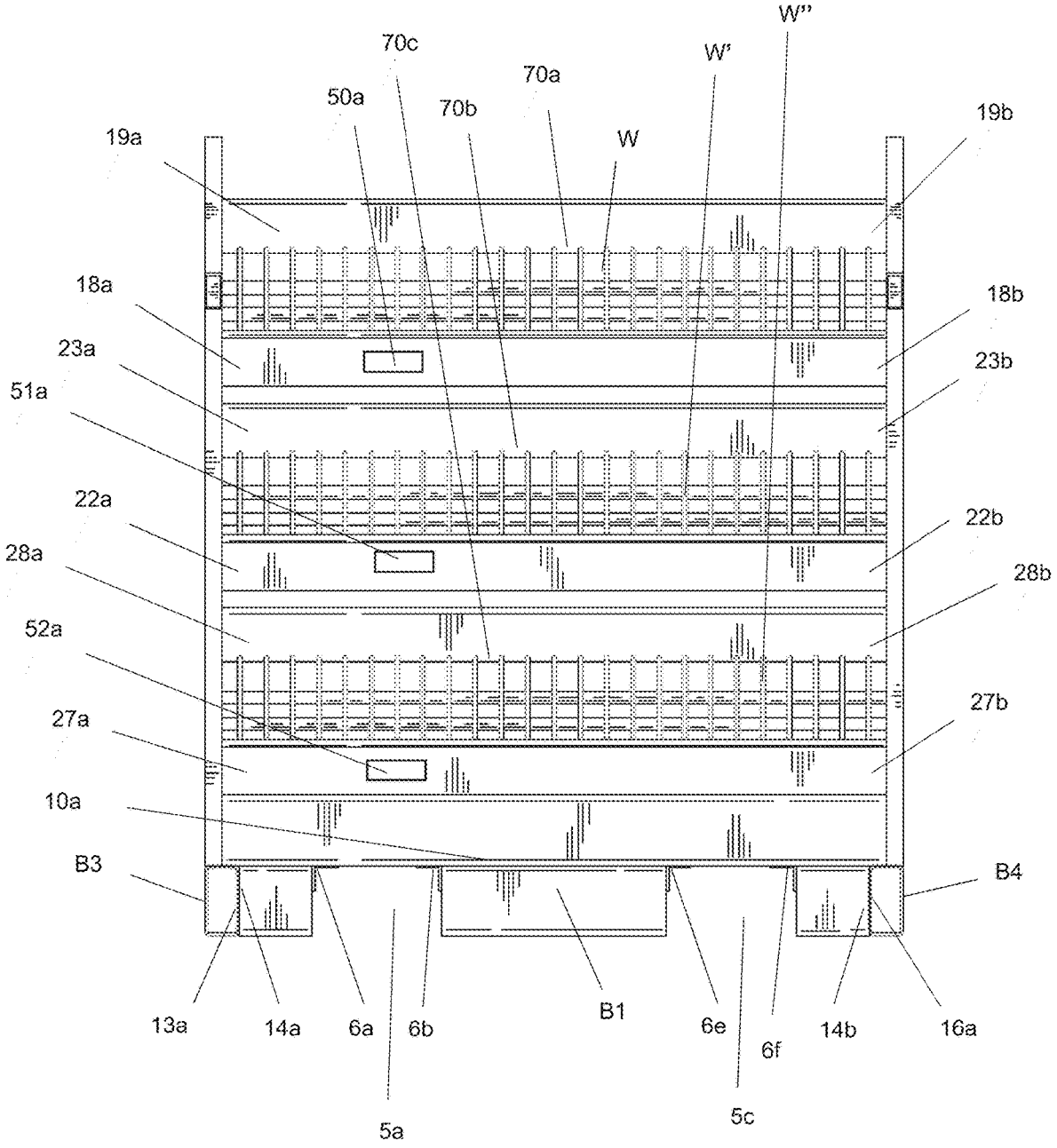
FIG. 2 shows a front view thereof.
Figure 3:
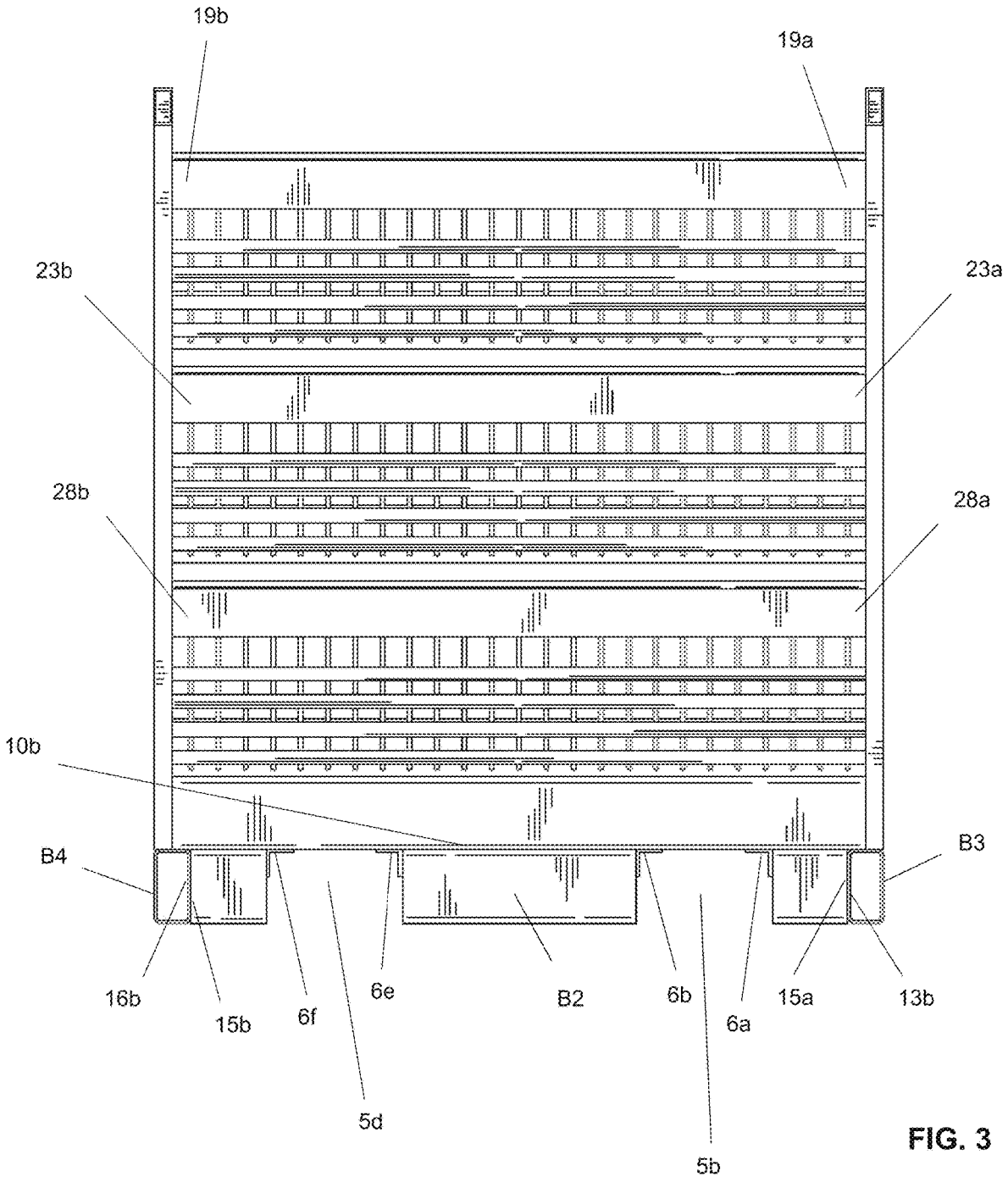
FIG. 3 shows a rear view thereof.

The pallet base 2 is preferably a squared or rectangular structure that comprises a first bar B1, a second bar B2, a third bar B3, and a fourth bar B4. The first bar B1 and the second bar B2 of the pallet base 2 are parallel to each other and perpendicular to the third bar B3 and the fourth bar B4. Similarly, the third bar B3 and fourth bar B4 of the pallet base 2 are parallel to each other and perpendicular to the first bar B1 and the second bar B2. Particularly, a first end 13*a* of the third bar B3 is perpendicularly welded or connected to a first end 14*a* of the first bar B1, as shown in FIG. 2; and a second end 13*b* of the third bar B3 is perpendicularly welded or connected to a first end 15*a* of the second bar B2, as shown in FIG. 3. Likewise, a first end 16*a* of the fourth bar B4 is perpendicularly welded or connected to a second end 14*b* of the first bar B1, as shown in FIG. 2; and a second end 16*b* the fourth bar B4 is connected to a second end 15*b* of the second bar B2, as shown in FIG. 3. As such, the first bar B1, the second bar B2, the third bar B3, and the fourth bar B4, define the perimeter or boundaries of the pallet base 2.

Figure 7:
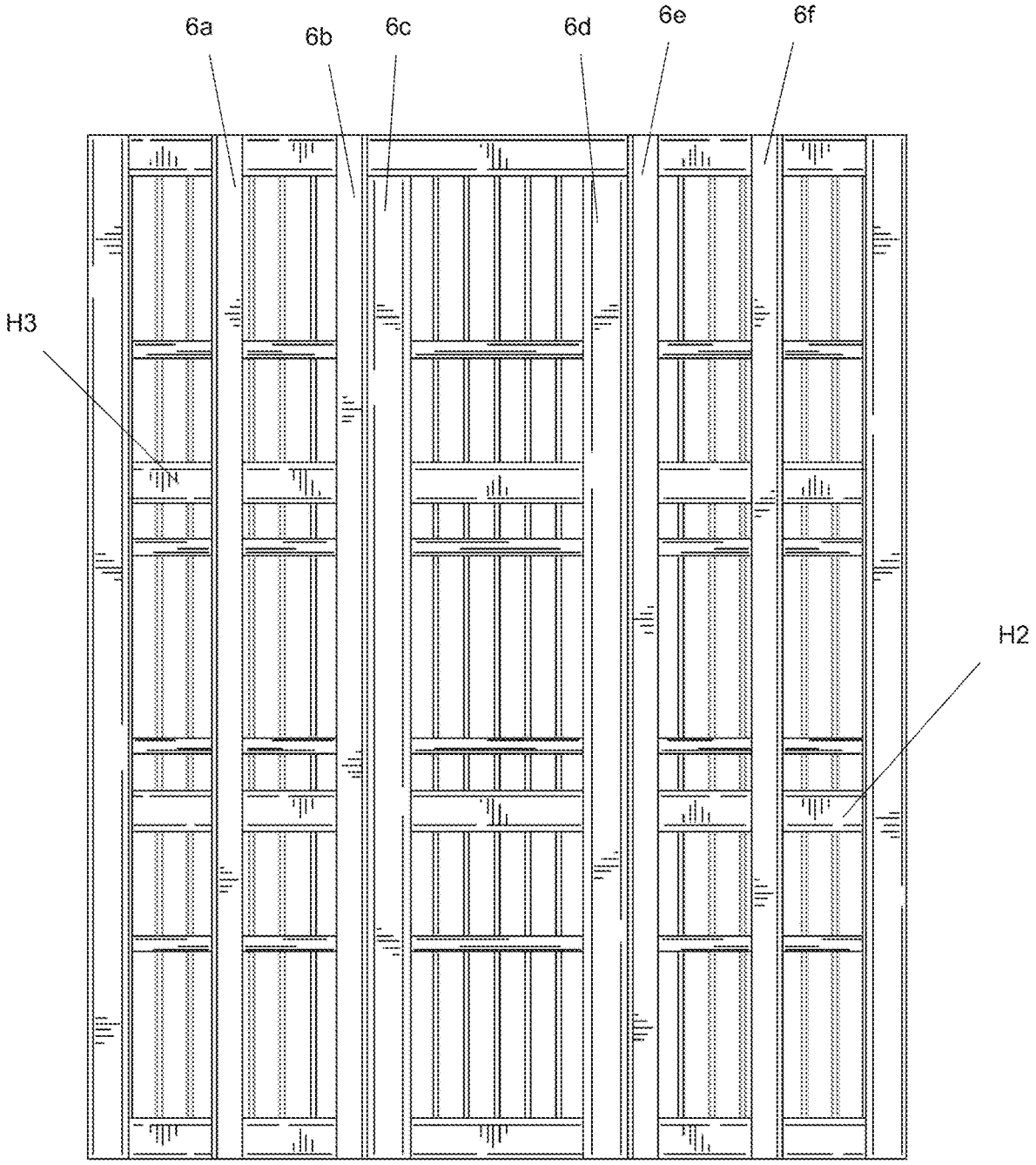
FIG. 7 shows a bottom view thereof.
Figure 8:
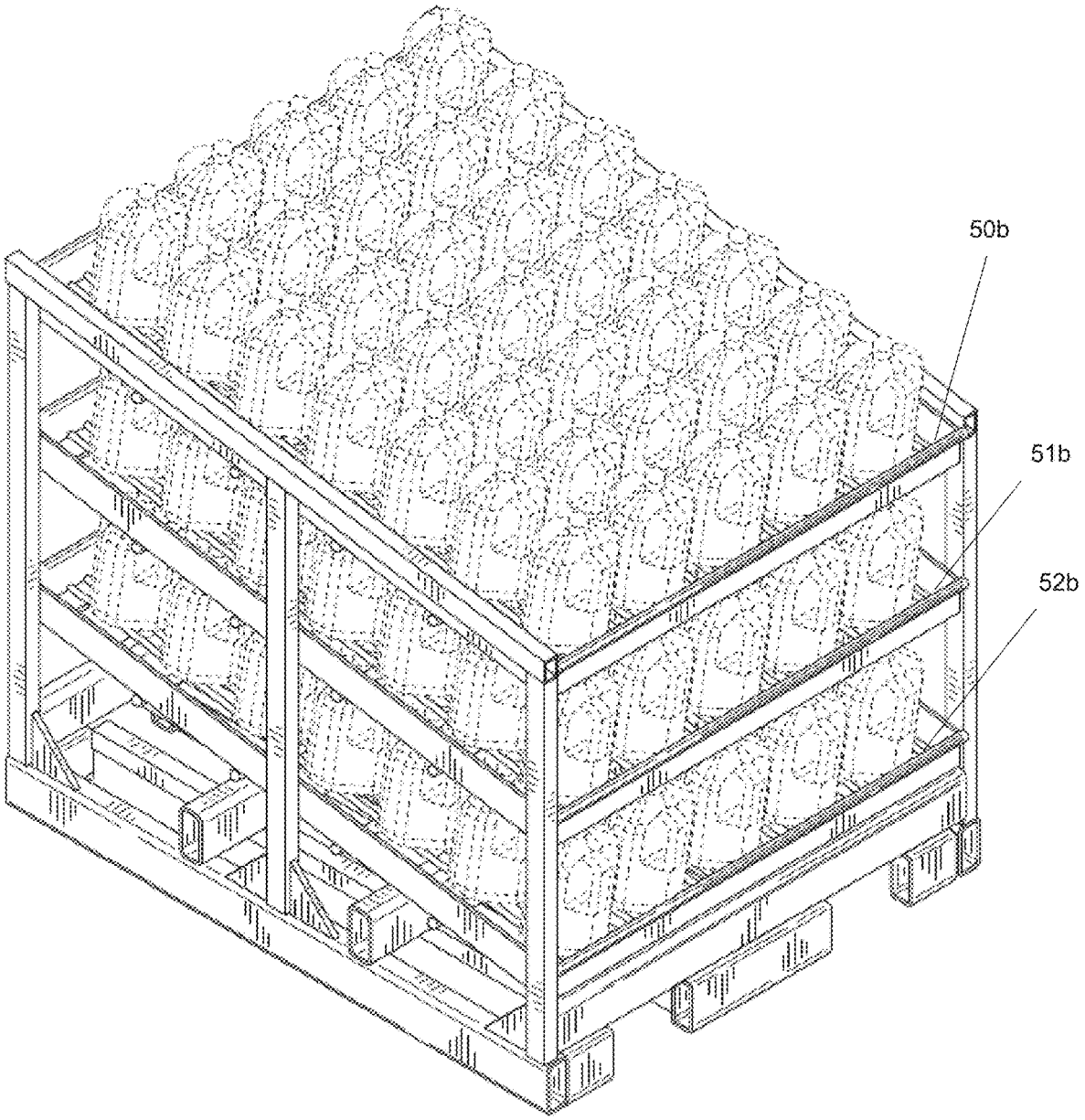
FIG. 8 shows another perspective view of the transportable gravity flow display rack for food and/or drink containers, having containers stored thereon.

Moreover, between the first bar B1 and the second bar B2, the pallet base 2 includes one or more longitudinal supporting structures 6*a-f* that are parallel to each other, as shown in FIG. 7. Each of the one or more longitudinal supporting structures 6*a-f* includes 1) a first end that is perpendicularly attached or welded to the first bar B1 of the pallet base 2; and 2) a second end that is perpendicularly attached or welded to the second bar B2 of the pallet base 2. The purpose of the longitudinal supporting structures 6*a*, 6*b*, 6*c*, 6*d*, 6*e*, and 6*f* is to provide support and stability to the pallet base 2; and, in the particular case of the longitudinal supporting structures 6*a*, 6*b*, 6*e*, and 6*f*, to define the area or channels of the pallet base 2 that will receive the forks of a forklift or pallet jack.

Particularly, the longitudinal supporting structures 6*a* and 6*b* define the area or channel that will receive a first fork from of a forklift; and the longitudinal supporting structures 6*e* and 6*f* define the area or channel that will receive a second fork from of a forklift, as shown in FIGS. 2 and 3. It should be noted that each of the first bar B1 and the second bar B2 of the pallet base 2 includes one or more openings 5*a*, 5*b*, 5*c*, 5*d*, that align with each other and are configured to receive the forks of a forklift or otherwise be lifted by a pallet jack. Particularly, the opening 5*a* on the first bar B1 of the pallet base 2 aligns with the opening 5*b* on the second bar B2 of the pallet base 2; and the opening 5*c* on the first bar B1 of the pallet base 2 aligns with the opening 5*d* on the second bar B2 of the pallet base 2. As such, each of the openings 5*a* and 5*b* act as an entrance into the area or channel defined by the longitudinal supporting structures 6*a* and 6*b*; and each of the openings 5*c* and 5*d* act as an entrance into the area or channel defined by the longitudinal supporting structures 6*e* and 6*f*, as shown in FIGS. 2 and 3. This configuration described for the pallet base 2 allows for the transportable gravity flow storage rack 1 to be moved from one place to the next with or without the food or drink containers stored thereon.

One method of use of the transportable gravity flow storage rack 1 is to have at least one transportable gravity flow storage rack in the floor or area of an establishment; and one or more fully stacked transportable gravity flow storage racks in storage. When the transportable gravity flow storage rack in the floor or area of the establishment empties out, it is removed with the aid of a pallet jack or forklift and replaced with one of the fully stacked transportable gravity flow storage racks in storage, and so on. Another method of use is for the store to receive a fully stacked transportable gravity flow storage rack directly from the food/drink manufacturing company. When the previous transportable gravity flow storage rack in the store empties out, the manufacturing company can be scheduled to pick up the empty transportable gravity flow storage rack and replace it with a fully stocked one.

Figure 1:
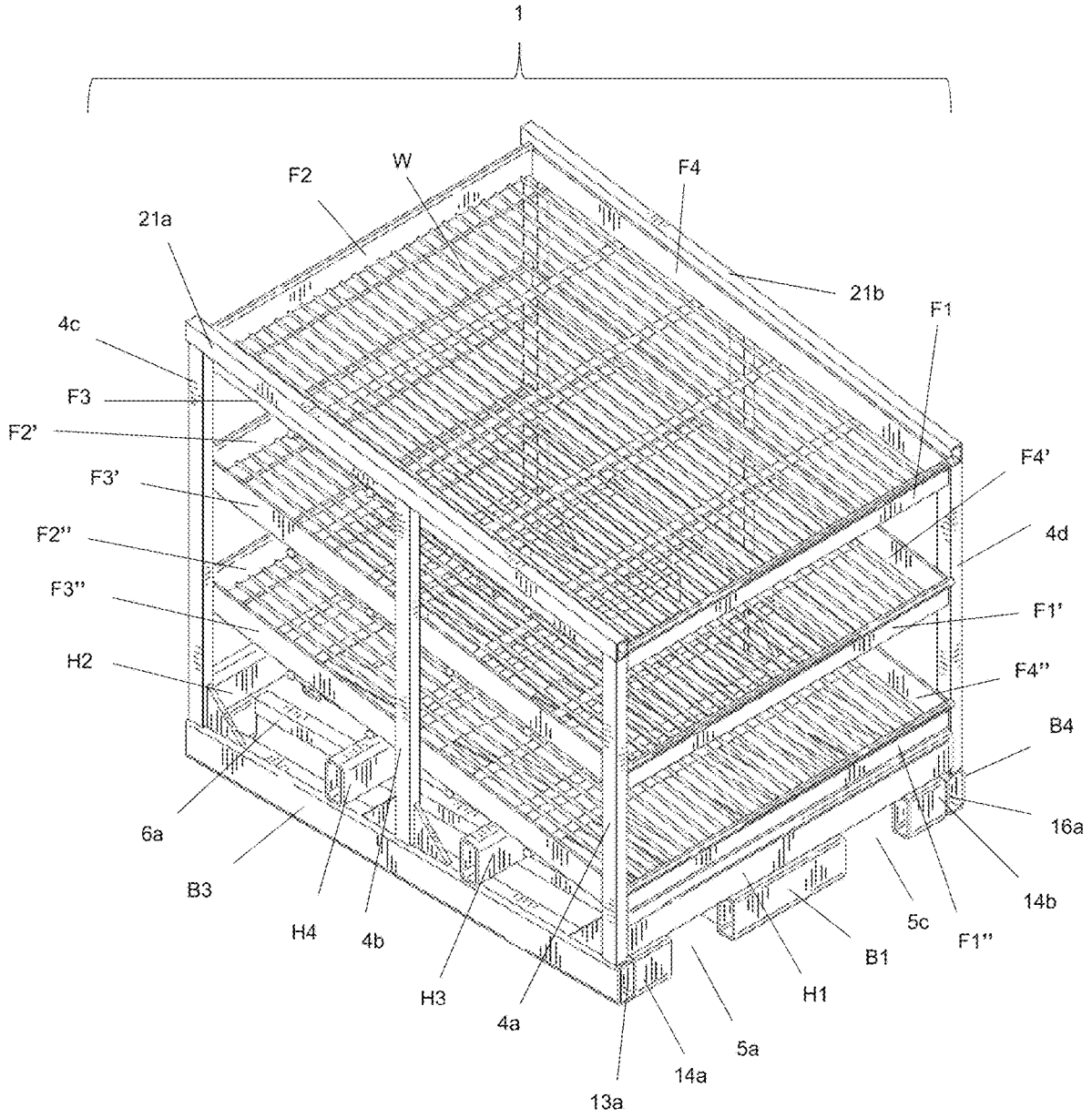
FIG. 1 shows a perspective view of a transportable gravity flow display rack for food and/or drink containers, in accordance with the principles of the present invention.

The pallet base 2 may also include one or more horizontal support bars H1, H2, H3, H4, adapted to provide additional support to the pallet base 2, as shown in FIG. 1. The first horizontal support bar H1 runs parallel to, and is welded or connected to, a top portion 10*a* of the first bar B1. Likewise, the second horizontal support bar H2 runs parallel to, and is welded or connected to, a top portion 10*b* of the second bar B2. The third horizontal support bar H3 and the fourth horizontal support bar H4 run parallel to the first and second horizontal support bars H1, H2, and each includes a first end (7*a*, 8*a* respectively) that is connected or welded to the third bar B3; and a second end (7*b*, 8*b* respectively) that is connected or welded to the fourth bar B4 of the pallet base 2. The first ends 7*a*, 8*a* and second ends 7*b*, 8*b* of the third horizontal support bar H3 and the fourth horizontal support bar H4 may be open ended, in order to provide access to the forks of a forklift In this manner the transportable gravity flow storage rack 1 can be lifted from the side. The third horizontal support bar H3 and the fourth horizontal support bar H4 may also be welded or connected to a top portion of the longitudinal supporting structures 6*a-fb*.

The plurality of vertical upright supports 4*a*, 4*b*, 4*c*, 4*d*, 4*e*, 4*f* are preferably spaced apart from each other and are located at or near the perimeter of the pallet base 2. Moreover, each of the vertical upright supports 4*a*, 4*b*, 4*c*, 4*d*, 4*e*, 4*f* comprises a first end and a second end. Particularly, as shown in FIG. 5, a first end E1 of the first vertical upright support 4*a* is connected or welded to a proximal portion 11*a* of the third bar B3; a first end E2 of the second upright support 4*b* is connected or welded to a middle portion 11*b* of the third bar B3; and a first end E3 of the third upright support 4*c* is connected or welded to a distal portion 11*c* of the third bar B3. Similarly, as shown in FIG. 4, a first end E4 of the fourth vertical upright support 4*d* is connected or welded to a proximal portion 12*a* of the fourth bar B4; a first end E5 of the fifth vertical upright support 4*e* is connected or welded to a middle portion 12*b* of the fourth bar B4; and a first end E6 of the sixth vertical upright support 4*f* is connected or welded to a distal portion 12*c* of the fourth bar B4.

Additionally, the first end of each of the first, second, and third vertical upright supports 4*a*, 4*b*, 4*c*, may include one or more stability triangles 30, 31, 32, 33 connected or welded therein and to the third bar B3. Similarly, the first end of each of the fourth, fifth, and sixth vertical upright supports 4*d*, 4*e*, 4*f* may include one or more stability triangles 34, 35, 36, 37 connected or welded therein and to the or fourth bar B4. For example, as shown in FIG. 5, first side of the first stability triangle 30 is welded to the first end E1 of the first vertical upright support 4*a* and a second side of the first stability triangle 30 is welded to the proximal portion 11*a* of the third bar B3. Similarly, a first side of the second stability triangle 31 is welded to the first end E2 of the second vertical upright support 4*b* and a second side of the second stability triangle 31 is welded to the middle portion 11*b* of the third bar B3. A first side of the third stability triangle 32 is also welded to the first end E2 of the second vertical upright support 4*b* and a second side of the third stability triangle 32 is welded to the middle portion 11*b* of the third bar B3. It should be noted, however, that the second stability triangle 31 and the third stability triangle 32 are welded to opposite sides of the second vertical upright support 4*b*; and not on the same face of the second vertical upright support 4*b*. In other words, the first side of each stability triangle 31, 32 is welded to opposite faces of the second vertical upright support 4*b*. Lastly, a first side of the fourth stability triangle 33 is welded to the first end E3 of the third vertical upright support 4*c* and a second side of the fourth stability triangle 33 is welded to the distal portion 11*c* of the third bar B3.

Figure 4:
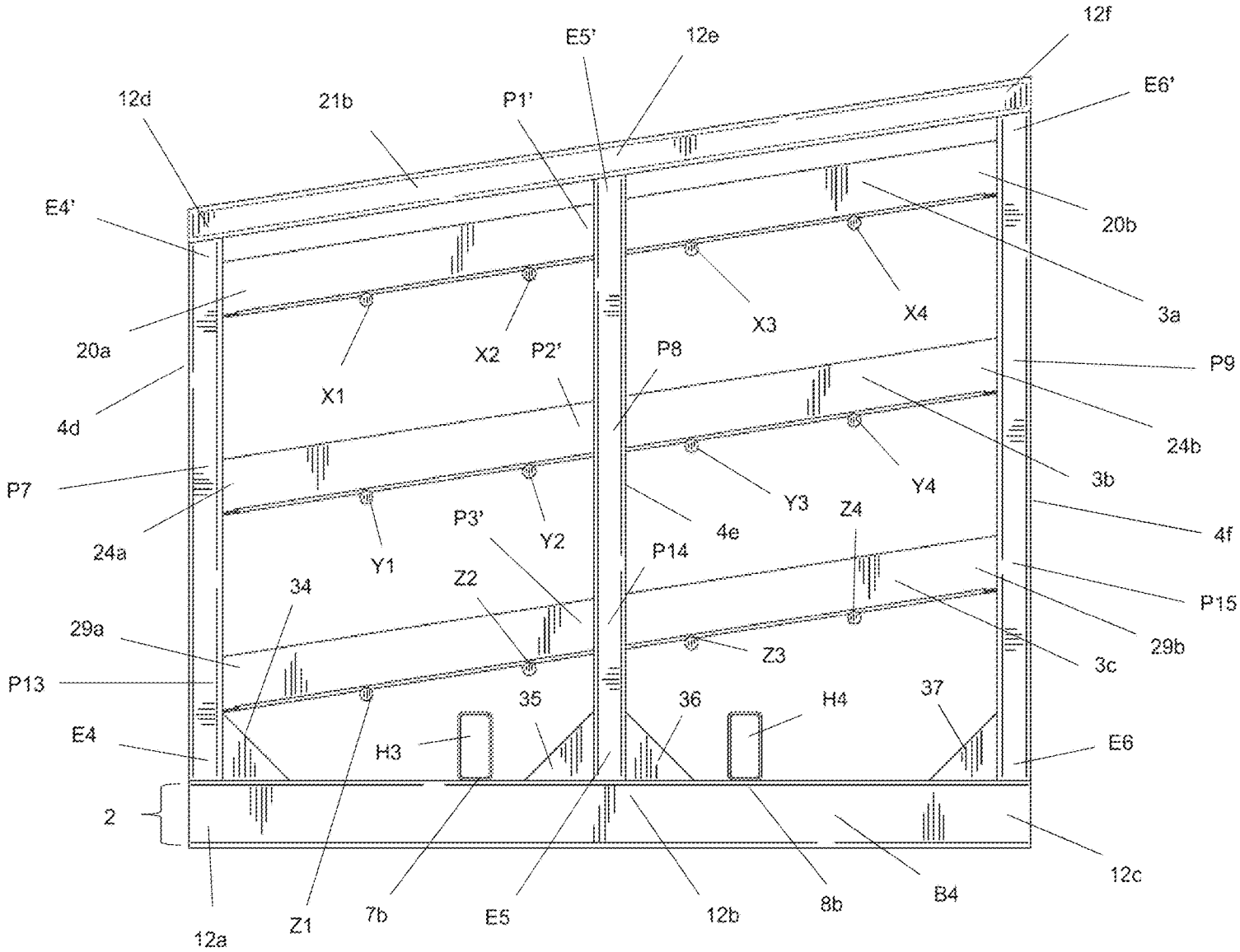
FIG. 4 shows left-side view thereof.
Figure 5:
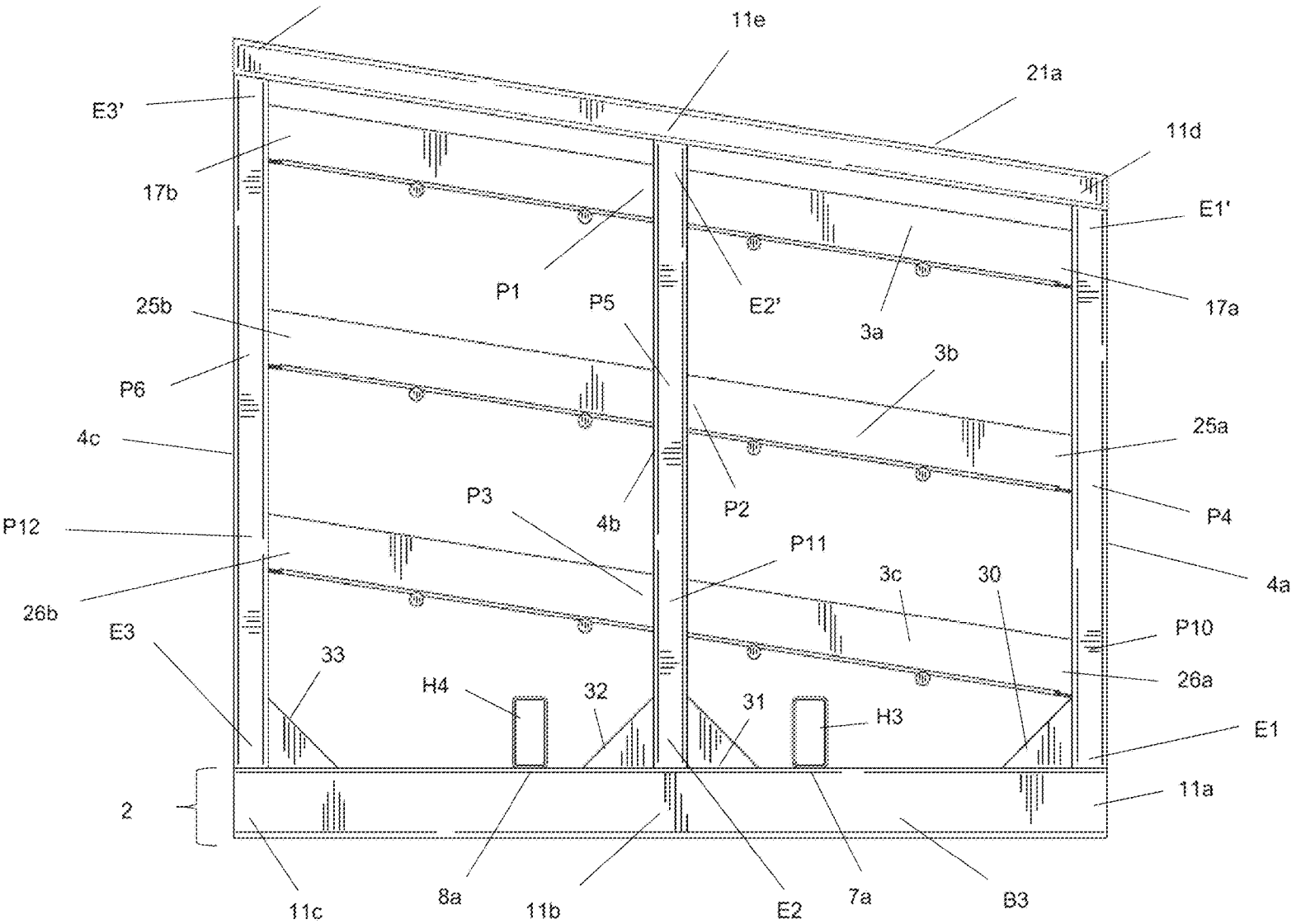
FIG. 5 shows a right-side view thereof.
Figure 6:
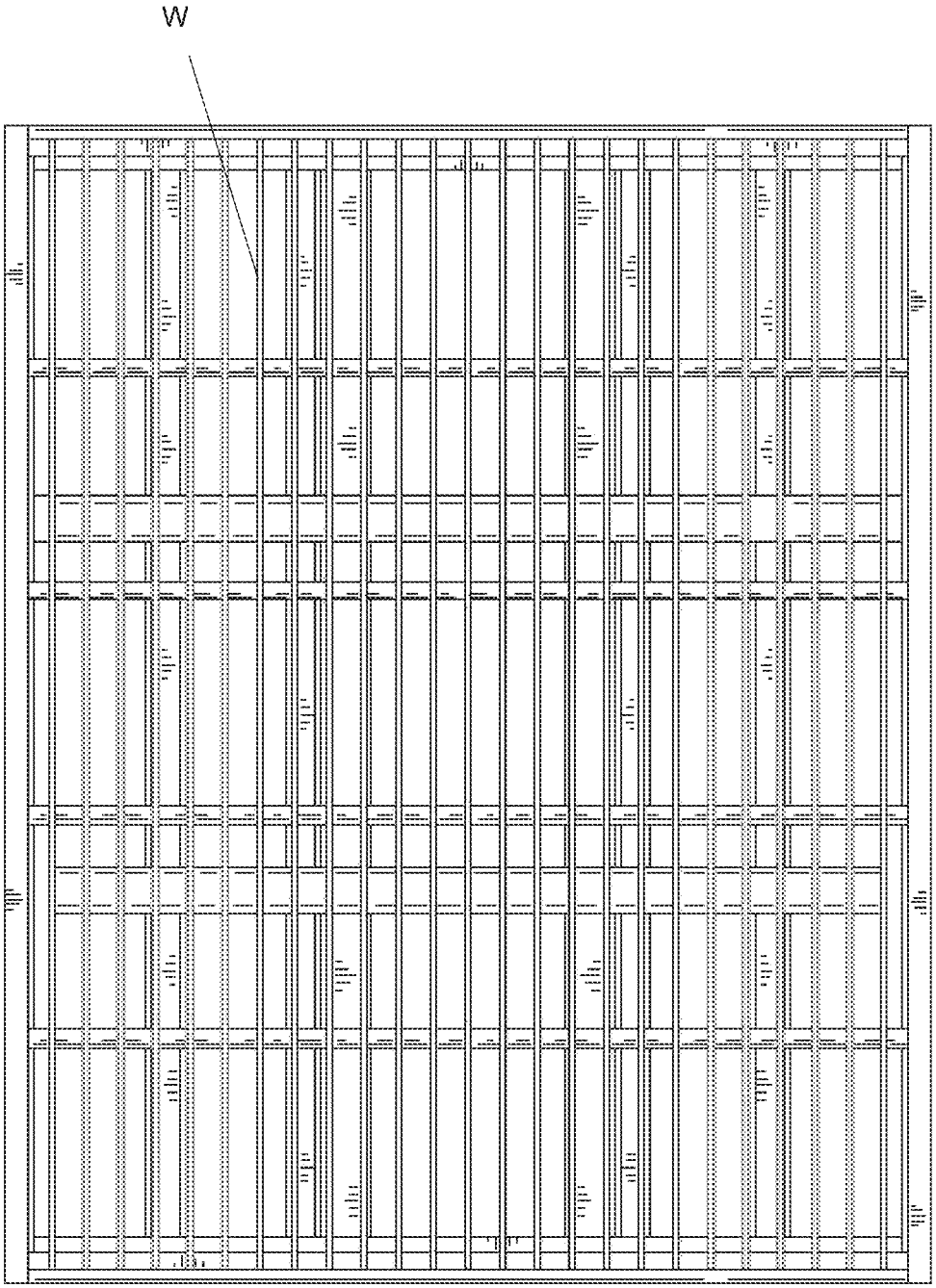
FIG. 6 shows a top view thereof.

As shown in FIG. 4, a first side of the fifth stability triangle 34 is welded to the first end E4 of the fourth vertical upright support 4*d* and a second side of the fifth stability triangle 34 is welded to the proximal portion 12*a* of the fourth bar B4. Similarly, a first side of the sixth stability triangle 35 is welded to the first end E5 of the fifth vertical upright support 4*e* and a second side of the second sixth triangle 35 is welded to the middle portion 12*b* of the fourth bar B4. A first side of the seventh stability triangle 36 is also welded to the first end E5 of the fifth vertical upright support 4*e* and a second side of the seventh stability triangle 36 is welded to the middle portion 12*b* of the fourth bar B4. It should be noted, however, that the sixth stability triangle 35 and the seventh stability triangle 36 are welded to opposite sides of the fifth vertical upright support 4*e*; and not on the same face of the fifth vertical upright support 4*e*. In other words, the first side of each stability triangle 35, 36 is welded to opposite faces of the fifth vertical upright support 4*e*. Lastly, a first side of the eight stability triangle 37 is welded to the first end E6 of the sixth vertical upright support 4*f* and a second side of the eight stability triangle 37 is welded to the distal portion 12*c* of the fourth bar B4. The purpose of the one or more stability triangles 30-37 is to provide more stability and support to the first end of the vertical upright supports 4*a*, 4*b*, 4*c*, 4*d*, 4*e*, 4*f*, thereby reducing shaking or the instability of these vertical upright supports.

The second end of the vertical upright supports 4*a*, 4*b*, 4*c*, 4*d*, 4*e*, 4*f*, on the other hand, are connected or welded to either the first crossbar 21*a* or to the second crossbar 21*b*, as explained below. As shown in FIG. 5, a second end E1' of the first vertical upright support 4*a* is connected or welded to a proximal portion 11*d* of the first crossbar 21*a*; a second end E2' of the second upright support 4*b* is connected or welded to a middle portion 11*e* of the first crossbar 21*a*; and a second end E3' of the third upright support 4*c* is connected or welded to a distal portion 11*f* of the first crossbar 21*a*. Similarly, and as shown in FIG. 4, a second end E4' of the fourth vertical upright support 4*d* is connected or welded to a proximal portion 12*d* of the second crossbar 21*b*; a second end E5' of the fifth upright support 4*e* is connected or welded to a middle portion 12*e* of the second crossbar 21*b*; and a second end E6' of the sixth upright support 4*f* is connected or welded to a distal portion 12*f* of the second crossbar 21*b*.

Each of the inclined storage racks 3*a*, 3*b*, 3*c*, has the same configuration, as explained below. The inclined racks facilitate the flow of the containers stored therein towards a costumer in response to gravity. That is, as the costumer grabs one container, the other containers move forward, thereby facilitating access to the containers in the back of the rack. The first inclined storage rack 3*a* comprises a first bar F1, a second bar F2, a third bar F3, and a fourth bar F4. It should be noted that the outer face of the first bar F1 (i.e., portion of the first bar of facing the customer) has an area 50*a* that is adapted to receive labeling of the brand, identity, and/or price tag of the food/drink containers stored in the first inclined storage rack 3*a*. The inner face 50*b* of the first bar F1 (i.e., portion of the first bar of facing the food/drink container), on the other hand, is adapted to prevent the containers stored in the first inclined storage rack 3*a* from falling over to the ground. Moreover, the first bar F1 and the second bar F2 of the first inclined rack 3*a* are parallel to each other and perpendicular to the third bar F3 and the fourth bar F4. Similarly, the third bar F3 and fourth bar F4 of the first inclined rack 3*a* are parallel to each other and perpendicular to the first bar F1 and the second bar F2. Particularly, as shown in FIGS. 2-5, a first end 17*a* of the third bar F3 is perpendicularly welded or connected to a first end 18*a* of the first bar F1; and a second end 17*b* of the third bar F3 is perpendicularly welded or connected to a first end 19*a* of the second bar F2. Likewise, a first end 20*a* of the fourth bar F4 is perpendicularly welded or connected to a second end 18*b* of the first bar F1; and a second end 20*b* the fourth bar F4 is connected to a second end 19*b* of the second bar F2. As such, the first bar F1, the second bar F2, the third bar F3, and the fourth bar F4, define the perimeter or boundaries of the first inclined storage rack 3*a*. Within said perimeter the first inclined storage rack 3*a* comprises a plurality of parallel longitudinal bars W That are spaced apart from each other and are adapted to receive food or drink containers. The longitudinal bars W can be any wire shelf-like structure or similar structure (including flat a surface) that is configured to hold food or drink containers. The longitudinal bars W should preferably be coated with a slippery or friction resistant material to allow the stored items to move to their forward-most position for increased presentation to and easier access by customers. The plurality of parallel longitudinal bars W include a first end connected or welded to the inner face 50*b* of the first bar F1 of the first inclined storage rack 3*a*; and a second end connected or welded to a first face 70*a* of the second bar F2 of the first inclined storage rack 3*a*. As shown in FIG. 4, the first inclined storage rack 3*a* may also comprise one or more horizontal stability bars X1, X2, X3, X4 perpendicularly attached or welded beneath the plurality of parallel longitudinal bars W. In this manner, the horizontal stability bars x1, X2, X3, X4 provide stability to the parallel longitudinal bars W when containers are placed therein. The horizontal stability bars X1, X2, X3, X4 may also be welded to the third bar F3 and the fourth bar F4. Lastly, it should be noted that the first inclined storage rack 3*a* is welded to each of the vertical upright supports 4*a*-4*f*.

Similarly, the second inclined storage rack 3*b* comprises a first bar F1', a second bar F2', a third bar F3', and a fourth bar F4'. The first bar F1' and the second bar F2' of the second inclined rack 3*b* are parallel to each other and perpendicular to the third bar F3' and the fourth bar F4'. It should be noted that the outer face of the first bar F1' (i.e., portion of the first bar of facing the customer) has an area 51*a* that is adapted to receive labeling of the brand, identity, and/or price tag of the food/drink containers stored in the second inclined storage rack 3*b*. The inner face 51*b* of the first bar F1' (i.e., portion of the first bar of facing the food/drink container), on the other hand, is adapted to prevent the containers stored in the second inclined storage rack 3*b* from falling over to the ground. Moreover, the third bar F3' and fourth bar F4' of the second inclined rack 3*b* are parallel to each other and perpendicular to the first bar F1' and the second bar F2'. Particularly, as shown in FIGS. 2-5, a first end 25*a* of the third bar F3' is perpendicularly welded or connected to a first end 22*a* of the first bar F1'; and a second end 25*b* of the third bar F3' is perpendicularly welded or connected to a first end 23*a* of the second bar F2'. Likewise, a first end 24*a* of the fourth bar F4' is perpendicularly welded or connected to a second end 22*b* of the first bar F1'; and a second end 24*b* the fourth bar F4' is connected to a second end 23*b* of the second bar F2'. As such, the first bar F1', the second bar F2', the third bar F3', and the fourth bar F4', define the perimeter or boundaries of the second inclined storage rack 3*b*. Within said perimeter the second inclined storage rack 3*b* comprises a plurality of parallel longitudinal bars W' that are spaced apart from each other and are adapted to receive food or drink containers. The longitudinal bars W' can be any wire shelf-like structure or similar structure (including a flat surface) that is configured to hold food or drink containers. The longitudinal bars W' should preferably be coated with a slippery or friction resistant material to allow the stored items to move to their forward-most position for increased presentation to and easier access by customers. The plurality of parallel longitudinal bars W' include a first end connected or welded to the inner face 51*b* of the first bar F1' of the second inclined storage rack 3*b*; and a second end connected or welded to a first face 70*b* of the second bar F2' of the second inclined storage rack 3*b*. As shown in FIG. 4, the second inclined storage rack 3*b* may also comprise one or more horizontal stability bars Y1, Y2, Y3, Y4 perpendicularly attached or welded beneath the plurality of parallel longitudinal bars W'. In this manner, the horizontal stability bars Y1, Y2, Y3, Y4 provide stability to the parallel longitudinal bars W' when containers are placed therein. The horizontal stability bars Y1, Y2, Y3, Y4 may also be welded to the third bar F3 and the fourth bar F4. Lastly, it should be noted that the second inclined storage rack 3*b* is welded to each of the vertical upright supports 4*a*-4*f*.

Likewise, the third inclined storage rack 3*c* comprises a first bar F1", a second bar F2", a third bar F3", and a fourth bar F4". The first bar F1" and the second bar F2" of the second inclined rack 3*b* are parallel to each other and perpendicular to the third bar F3" and the fourth bar F4". It should be noted that the outer face of the first bar F1" (i.e., portion of the first bar of facing the customer) has an area 52*a* that is adapted to receive labeling of the brand, identity, and/or price tag of the food/drink containers stored in the third inclined storage rack 3*c*. The inner face 52*b* of the first bar F1' (i.e., portion of the first bar of facing the food/drink container), on the other hand, is adapted to prevent the containers stored in the third inclined storage rack 3*c* from falling over to the ground. Moreover, the third bar F3" and fourth bar F4" of the third inclined rack 3*c* are parallel to each other and perpendicular to the first bar F1" and the second bar F2". Particularly, as shown in FIGS. 2-5, a first end 26*a* of the third bar F3" is perpendicularly welded or connected to a first end 27*a* of the first bar F1"; and a second end 26*b* of the third bar F3" is perpendicularly welded or connected to a first end 28*a* of the second bar F2". Likewise, a first end 29*a* of the fourth bar F4" is perpendicularly welded or connected to a second end 27*b* of the first bar F1"; and a second end 29*b* the fourth bar F4" is connected to a second end 28*b* of the second bar F2". As such, the first bar F1", the second bar F2", the third bar F3", and the fourth bar F4", define the perimeter or boundaries of the third inclined storage rack 3*c*. Within said perimeter the third inclined storage rack 3*c* comprises a plurality of parallel longitudinal bars W" that are spaced apart from each other and are adapted to receive food or drink containers. The longitudinal bars W" can be any wire shelf-like structure or similar (including a flat surface) that is configured to hold food or drink containers. The longitudinal bars W" should preferably be coated with a slippery or friction resistant material to allow the stored items to move to their forward-most position for increased presentation to and easier access by customers. The plurality of parallel longitudinal bars W" include a first end connected or welded to the inner face 52*b* of the first bar F1" of the third inclined storage rack 3*c*; and a second end connected or welded to a first face 70*c* of the second bar F2" of the third inclined storage rack 3*c*. As shown in FIG. 4, the third inclined storage rack 3*c* may also comprise one or more horizontal stability bars Z1, Z2, Z3, Z4 perpendicularly attached or welded beneath the plurality of parallel longitudinal bars W". In this manner, the horizontal stability bars Z1, Z2, Z3, Z4 provide stability to the parallel longitudinal bars W" when containers are placed therein. The horizontal stability bars Z1, Z2, Z3, Z4 may also be welded to the third bar F3 and the fourth bar F4. Lastly, it should be noted that the third inclined storage rack 3*c* is welded to each of the vertical upright supports 4*a*-4*f*.

As previously noted, each of the inclined storage racks 3*a*, 3*b*, 3*c*, are welded or connected to the vertical upright supports 4*a*, 4*b*, 4*c*, 4*d*, 4*e*, 4*f*. Particularly, the first end 18*a* of the first bar F1 of the first inclined storage racks 3*a* is welded or connected to the second end E1' of the first vertical upright support 4*a*; and the second end 18*b* of the first bar F1 of the first inclined storage rack 3*a* is welded or connected to the second end E4' of the fourth vertical upright support 4*d*. Moreover, the first end 19*a* of the second bar F2 of the first inclined storage rack 3*a* is welded or connected to the second end E3' of the third vertical upright support 4*c*; and the second end 19*b* of the second bar F2 of the first inclined storage rack 3*a* is welded or connected to the second end E6' of the sixth vertical upright support 4*f*. Additionally, a middle portion P1 of the third bar F3 of the first inclined storage rack 3*a* is welded or connected to the second end E2' of the second vertical upright support 4*b*; and a middle portion P1' of the fourth bar F4 of the first inclined storage rack 3*a* is welded or connected to the second end E5' of the fifth vertical upright support 4*e*.

Similarly, the first end 22*a* of the first bar F1' of the second inclined storage rack 3*b* is welded or connected to a middle portion P4 of the first vertical upright support 4*a*; and the second end 22*b* of the first bar F1' of the second inclined storage rack 3*b* is welded or connected to a mid-upper portion P7 of the fourth vertical upright support 4*d*. Moreover, the first end 23*a* of the second bar F2' of the second inclined storage rack 3*b* is welded or connected to a mid-upper portion P6 of the third vertical upright support 4*c*; and the second end 23*b* of the second bar F2' of the second inclined storage rack 3*b* is welded or connected to a mid-upper portion P9 of the sixth vertical upright support 4*f*. Additionally, a mid-upper portion P2 of the fourth bar F4' of the second inclined storage rack 3*b* is welded or connected to a mid-upper portion P5 of the second vertical upright support 4*b*; and a middle portion P2' of the fourth bar F4' of the second inclined storage rack 3*b* is welded or connected to a mid-upper P8 the fifth vertical upright support 4*e*.

Lastly, the first end 27*a* of first bar F1" of the third inclined storage rack 3*c* is welded or connected to a mid-lower portion P10 of the first vertical upright support 4*a*; and the second end 27*b* of first bar F1" of the third inclined storage rack 3*c* is welded or connected to a mid-lower portion P13 of the fourth vertical upright support 4*d*. Moreover, the first the first end 28*a* of the second bar F2" of the third inclined storage rack 3*c* is welded or connected to a mid-lower portion P12 of the third vertical upright support 4*c*; and the second end 28*b* of the second bar F2" of the third inclined storage rack 3*c* is welded or connected to a mid-lower portion P15 of the sixth vertical upright support 4*f*. Additionally, a middle portion P3 of the fourth bar F4" of the third inclined storage rack 3*c* is welded or connected to a mid-lower portion P11 of the second vertical upright support 4*b*; and a middle portion P3' of the fourth bar F4" of the third inclined storage rack 3*c* is welded or connected to a mid-lower portion P14 the fifth vertical upright support 4*e*.

It should be noted that the inclined storage racks 3*a*, 3*b*, 3*c* are on top or above of each other (i.e., the first inclined storage rack 3*a* is on top of the second inclined storage rack 3*b*, and the second inclined storage rack 3*b* is on top of the third inclined storage rack 3*c*). It should also be noted that each of the second bar F2 from the first inclined storage rack 3*a*, the second bar F2' from the second inclined storage rack 3*b*, and the second bar F2" from the third inclined storage rack 3*c* are welded or attached to the third vertical upright support 4*c* and the sixth vertical upright support 4*f* at a point vertically higher than the point where the first bar F1 from the first inclined storage rack, the first bar F1' from the second inclined storage rack 3*b*, and the first bar F1" from the third inclined storage rack 3*c* are welded or attached to the first vertical upright support 4*a* and the fourth vertical upright support 4*d*.

Figure 9:
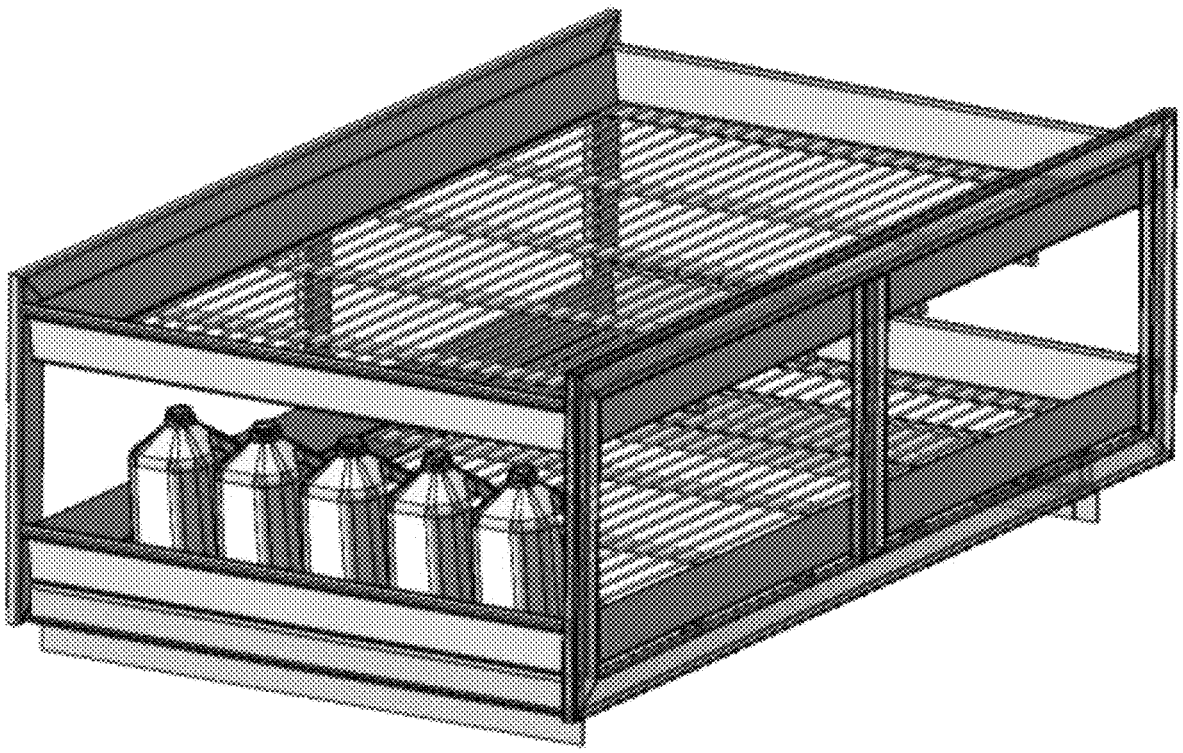
FIG. 9 shows a second embodiment of the transportable gravity flow display rack for food and/or drink containers, in accordance with the principles of the present invention.
Figure 10:
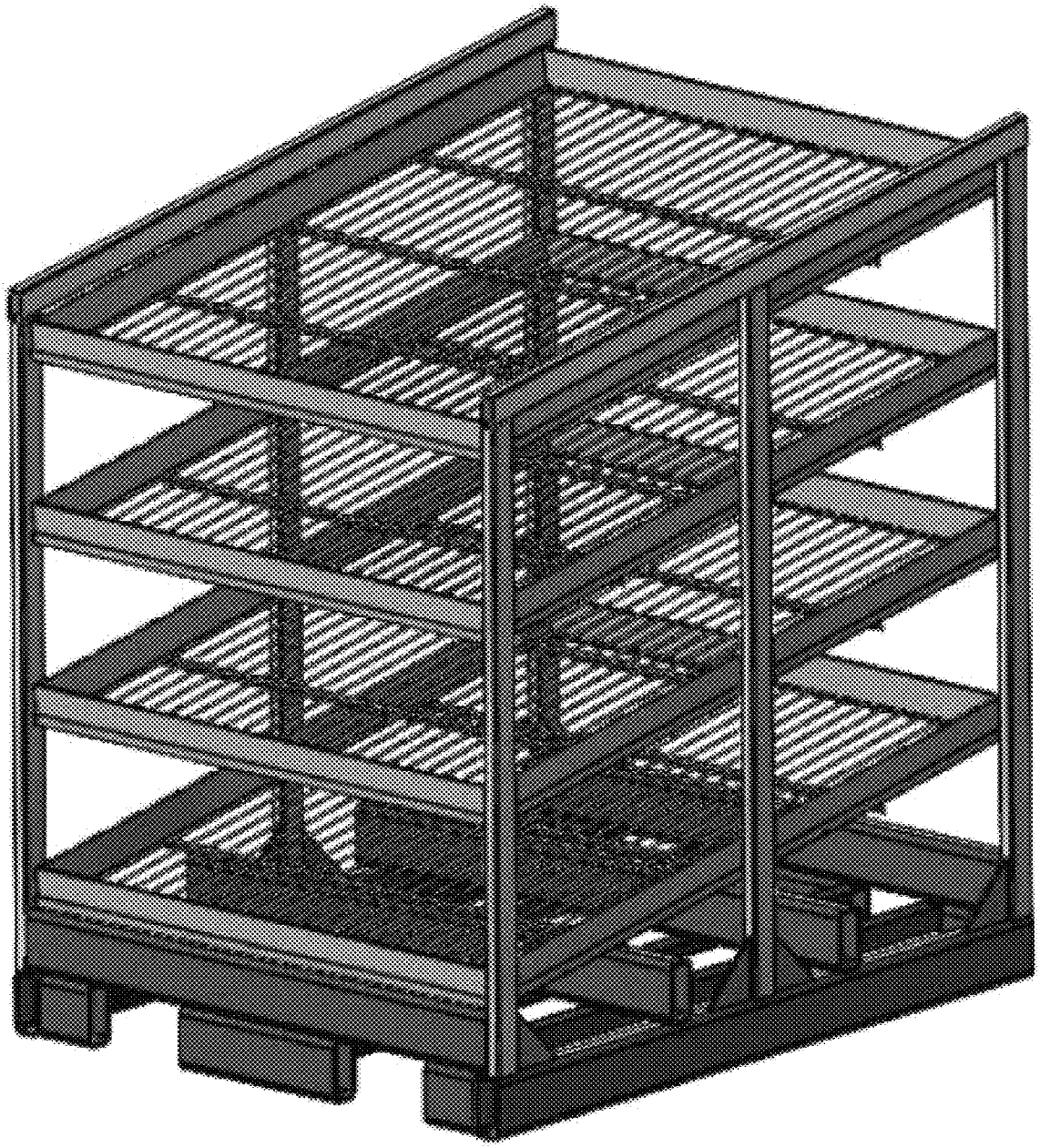
FIG. 10 shows a third embodiment of the transportable gravity flow display rack for food and/or drink containers, in accordance with the principles of the present invention.

While the embodiment described above includes three inclined storage racks, other embodiments of the transportable gravity flow storage rack 1 may include less than or more than three inclined storage racks, as shown in FIGS. 9 and 10.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

What is claimed is:

1. A transportable gravity flow storage rack for food and/or drink containers, comprising:

a pallet base;

one or more inclined storage racks;

a plurality of vertical upright supports including a first vertical upright support, a second vertical upright support, a third vertical upright support, a fourth vertical upright support, a fifth vertical upright support, and a sixth vertical upright support;

a first cross bar and a second cross bar;

wherein the pallet base comprises a first bar, a second bar, a third bar, and a fourth bar;

wherein between the first bar and the second bar, the pallet base includes one or more longitudinal supporting structures that are parallel to each other;

wherein each of the first bar and the second bar of the pallet base include one or more openings that align with each other and are configured to receive the forks of a forklift or pallet jack;

wherein the pallet base includes:

a first horizontal support bar that runs parallel to, and is connected to, a top portion of the first bar;

a second horizontal support bar that runs parallel to, and is connected to, a top portion of the second bar;

a third horizontal support bar and a fourth horizontal support bar that run parallel to the first and second horizontal support bars, wherein each includes a first end that is connected to the third bar, and a second end that is connected to the fourth bar of the pallet base;

wherein each of the vertical upright supports includes a first end and a second end;

wherein the first end of the first vertical upright support is connected to a proximal portion of the third bar, the first end of the second upright support is connected to a middle portion of the third bar, and the first end of the third upright support is connected to a distal portion of the third bar of the pallet base;

wherein the first end of the fourth vertical upright support is connected to a proximal portion of the fourth bar, the first end of the fifth upright support is connected to a middle portion of the fourth bar, and the first end of the sixth upright support is connected to a distal portion of the fourth bar of the pallet base;

wherein the first end of the first, second, and third vertical upright supports includes one or more stability triangles connected or welded therein and to the third bar of the pallet base;

wherein the first end of each of the fourth, fifth, and sixth vertical upright supports includes one or more stability triangles connected or welded therein and to the fourth bar of the pallet base;

wherein the second end of the first vertical upright support is connected to a proximal portion of the first crossbar, the second end of the second upright support is connected to a middle portion of the first crossbar, and the second end of the third upright support is connected to a distal portion of the first crossbar;

wherein the second end of the fourth vertical upright support is connected to a proximal portion of the second crossbar, the second end of the fifth upright support is connected to a middle portion of the second crossbar, and the second end of the sixth upright support is connected to a distal portion of the second crossbar;

wherein a first inclined storage rack from the one or more inclined storage racks comprises a first bar, a second bar, a third bar, and a fourth bar;

wherein a first end of the third bar of the first inclined storage rack is perpendicularly welded or connected to a first end of the first bar of the first inclined storage rack, and a second end of the third bar of the first inclined storage rack is perpendicularly welded or connected to a first end of the second bar of the first inclined storage rack;

wherein a first end of the fourth bar of the first inclined storage rack is perpendicularly welded or connected to a second end of the first bar of the first inclined storage rack, and a second end of the fourth bar of the first inclined storage rack is connected to a second end of the second bar of the first inclined storage rack;

wherein the first inclined storage rack comprises a plurality of parallel longitudinal bars that are spaced apart from each other and are adapted to receive food or drink containers;

wherein a second inclined storage rack from the one or more inclined storage racks comprises a first bar, a second bar, a third bar, and a fourth bar;

wherein a first end of the third bar of the second inclined storage rack is perpendicularly welded or connected to a first end of the first bar of the second inclined storage rack, and a second end of the third bar of the second inclined storage rack is perpendicularly welded or connected to a first end of the second bar of the second inclined storage rack;

wherein a first end of the fourth bar of the second inclined storage rack is perpendicularly welded or connected to a second end of the first bar of the second inclined storage rack, and a second end of the fourth bar of the second inclined storage rack is connected to a second end of the second bar of the second inclined storage rack;

wherein the second inclined storage rack comprises a plurality of parallel longitudinal bars that are spaced apart from each other and are adapted to receive food or drink containers;

wherein a third inclined storage rack from the one or more inclined storage racks comprises a first bar, a second bar, a third bar, and a fourth bar;

wherein a first end of the third bar of the third inclined storage rack is perpendicularly welded or connected to a first end of the first bar of the third inclined storage rack, and a second end of the third bar of the third inclined storage rack is perpendicularly welded or connected to a first end of the second bar of the third inclined storage rack;

wherein a first end of the fourth bar of the third inclined storage rack is perpendicularly welded or connected to a second end of the first bar of the third inclined storage rack, and a second end the fourth bar of the third inclined storage rack is connected to a second end of the second bar of the third inclined storage rack;

wherein the third inclined storage rack comprises a plurality of parallel longitudinal bars that are spaced apart from each other and are adapted to receive food or drink containers;

wherein the first end of the first bar of the first inclined storage rack is welded or connected to the second end of the first vertical upright support, and wherein the second end of the first bar of the first inclined storage rack is welded or connected to the second end of the fourth vertical upright support;

wherein the first end of the second bar of the first inclined storage rack is welded or connected to the second end of the third vertical upright support, and wherein the second end of the second bar of the first inclined storage rack is welded or connected to the second end of the sixth vertical upright support;

wherein a middle portion of the third bar of the first inclined storage rack is welded or connected to the second end of the second vertical upright support, and wherein a middle portion of the fourth bar of the first inclined storage rack is welded or connected to the second end of the fifth vertical upright support;

wherein the first end of the first bar of the second inclined storage rack is welded or connected to a middle portion of the first vertical upright support, and wherein the second end of the first bar of the second inclined storage rack is welded or connected to a middle portion of the fourth vertical upright support;

wherein the first end of the second bar of the second inclined storage rack is welded or connected to a mid-upper portion of the third vertical upright support, and wherein the second end of the second bar of the second inclined storage rack is welded or connected to a mid-upper portion of the sixth vertical upright support;

wherein a middle portion of the third bar of the second inclined storage rack is welded or connected to a mid-upper portion of the second vertical upright support, and wherein a middle portion of the fourth bar of the second inclined storage rack is welded or connected to a mid-upper of the fifth vertical upright support;

wherein the first end of first bar of the third inclined storage rack is welded or connected to a mid-lower portion of the first vertical upright support, and wherein the second end of first bar of the third inclined storage rack is welded or connected to a mid-lower portion of the fourth vertical upright support;

wherein the first the first end of the second bar of the third inclined storage rack is welded or connected to a mid-lower portion of the third vertical upright support, and wherein the second end of the second bar of the third inclined storage rack is welded or connected to a mid-lower portion of the sixth vertical upright support;

wherein a middle portion of the third bar of the third inclined storage rack is welded or connected to a mid-lower portion of the second vertical upright support, and wherein a middle portion of the fourth bar of the third inclined storage rack is welded or connected to a mid-lower portion the fifth vertical upright support; and wherein each of the second bar from the first inclined storage rack, the second bar from the second inclined storage rack, and the second bar from the third inclined storage rack are welded or connected to the third vertical upright support and the sixth vertical upright support at a point vertically higher than a point where the first bar from the first inclined storage rack, the first bar from the second inclined storage rack, and the first bar from the third inclined storage rack are welded or connected to the first vertical upright support and the fourth vertical upright support, respectively.

2. The transportable gravity flow storage rack of claim 1, wherein each of the one or more longitudinal supporting structures includes a first end that is perpendicularly attached to the first bar of the pallet base, and a second end that is perpendicularly attached to the second bar of the of the pallet base.

3. The transportable gravity flow storage rack of claim 1, wherein each of the first bar of the first inclined storage rack, the first bar of the second inclined storage rack, and the first bar of the third inclined storage rack includes a first face with an area that is adapted to receive labeling of a brand, identity, and/or price tag of the food/drink containers stored in the first inclined storage rack.

4. The transportable gravity flow storage rack of claim 1, wherein the first inclined storage rack comprises one or more horizontal stability bars perpendicularly attached or welded beneath the plurality of parallel longitudinal bars.

5. The transportable gravity flow storage rack of claim 1, wherein the second inclined storage rack comprises one or more horizontal stability bars perpendicularly attached or welded beneath the plurality of parallel longitudinal bars.

6. The transportable gravity flow storage rack of claim 1, wherein the third inclined storage rack comprises one or more horizontal stability bars perpendicularly attached or welded beneath the plurality of parallel longitudinal bars.

7. The transportable gravity flow storage rack of claim 1, wherein the plurality of parallel longitudinal bars in the first inclined storage rack include a first end connected or welded to the first bar of the first inclined storage rack, and a second end connected or welded to the second bar of the first inclined storage rack.

8. The transportable gravity flow storage rack of claim 1, wherein the plurality of parallel longitudinal bars in the second inclined storage rack include a first end connected or welded to the first bar of the second inclined storage rack, and a second end connected or welded to the second bar of the second inclined storage rack.

9. The transportable gravity flow storage rack of claim 1, wherein the plurality of parallel longitudinal bars in the third inclined storage rack include a first end connected or welded to the first bar of the third inclined storage rack, and a second end connected or welded to the second bar of the third inclined storage rack.

10. The transportable gravity flow storage rack of claim 1, wherein the second inclined storage rack is located on top or above the third inclined storage rack, and wherein the first inclined storage rack is located on top or above the second inclined storage rack.

* * * * *